US012336575B1

(12) United States Patent
Lau

(10) Patent No.: US 12,336,575 B1
(45) Date of Patent: Jun. 24, 2025

(54) OUTER GARMENT WITH COVERTLY RELEASABLE FLAP

(71) Applicant: Shui Lau, Lewis Center, OH (US)

(72) Inventor: Shui Lau, Lewis Center, OH (US)

( * ) Notice: Subject to any disclaimer, the term of this patent is extended or adjusted under 35 U.S.C. 154(b) by 48 days.

(21) Appl. No.: 18/097,317

(22) Filed: Jan. 16, 2023

(51) Int. Cl.
*A41D 27/02* (2006.01)
*A41D 13/00* (2006.01)
*F41C 33/04* (2006.01)

(52) U.S. Cl.
CPC ..... *A41D 13/0012* (2013.01)

(58) Field of Classification Search
CPC ..... A41D 13/0012
See application file for complete search history.

(56) References Cited

U.S. PATENT DOCUMENTS 605,077 A * 6/1898 Carter ..... A41D 13/0012 2/94
745,927 A * 12/1903 Sweeney ..... A41D 27/20 2/253
1,623,993 A * 4/1927 Anderson ..... B63C 9/1255 2/102
1,878,275 A * 9/1932 Goldman ..... A41D 27/20 2/247
1,951,240 A * 3/1934 Gold ..... A41D 1/02 2/96
2,180,914 A * 11/1939 Speh ..... A41D 27/20 2/253
2,304,251 A * 12/1942 Freedman ..... A41B 1/00 2/115
2,859,449 A * 11/1958 Ellison ..... A41D 27/20 2/253
3,611,444 A * 10/1971 Rector ..... A41D 27/20 2/227
3,688,315 A * 9/1972 Helmur ..... A41D 27/20 2/252
4,325,378 A * 4/1982 Wilkinson ..... A41C 3/0057 450/77
4,502,154 A * 3/1985 Itoi ..... A41D 15/04 2/108
5,495,620 A * 3/1996 Schoenweiss ..... F41H 1/02 2/92
5,509,147 A * 4/1996 Busquets ..... A41D 27/202 2/253

(Continued)

OTHER PUBLICATIONS https://www.recoilweb.com/5-11-releases-the-taclite-anorak-75681.html; Oct. 30, 2015.

*Primary Examiner* — Robert H Muromoto, Jr.
(74) *Attorney, Agent, or Firm* — Shaddock Law Group, PC

(57) ABSTRACT

A outer garment with releasable flap, including a garment body wherein an outer portion of the garment body extends from the centerline to a terminal side edge to form a gap in the outer portion; a flap positioned so as to overlay the gap, wherein at least a portion of the flap proximate a terminal bottom edge of the flap and proximate a terminal side edge of the flap is releasably attached or coupled to at least a portion of the outer portion of the garment body, via one or more releasable fasteners; and a faux pocket opening formed between at least a portion of the flap and at least a portion of the outer portion of the garment body, wherein the one or more releasable fasteners are between the faux pocket opening and the terminal bottom edge of the outer portion.

20 Claims, 7 Drawing Sheets

(56) References Cited

U.S. PATENT DOCUMENTS 5,689,829 A * 11/1997 Rose ..... F41C 33/00 2/77
5,692,237 A * 12/1997 Bennett ..... F41C 33/00 2/93
5,845,336 A * 12/1998 Golde ..... A41D 27/28 2/93
6,131,198 A * 10/2000 Westrick ..... F41C 33/048 2/2.5
6,760,922 B1 * 7/2004 Morales ..... A41D 13/0012 2/102
6,986,164 B1 * 1/2006 Morales ..... A41D 13/0012 2/102
RE40,613 E * 1/2009 Jordan ..... A41D 27/205 2/94
7,631,368 B1 * 12/2009 Samson ..... F41C 33/02 2/77
7,743,430 B2 * 6/2010 Jennings ..... A45C 1/04 2/94
8,307,465 B2 * 11/2012 French ..... F41C 33/02 2/253
8,312,568 B2 * 11/2012 Marois ..... A41D 27/20 2/253
8,341,769 B2 * 1/2013 Fayle ..... A41D 27/10 2/84
8,856,970 B2 * 10/2014 French ..... F41C 33/0218 2/250
8,898,813 B2 * 12/2014 Davis ..... A41D 13/02 2/79
9,009,870 B1 * 4/2015 Connick, Jr. ..... A41D 27/20 2/252
9,247,774 B2 * 2/2016 Davis ..... A41D 13/02
9,332,796 B2 * 5/2016 Edwards ..... A41D 1/04
9,414,631 B2 * 8/2016 Schrimpf ..... A41D 27/205
9,557,139 B1 * 1/2017 Miner ..... A44B 18/0073
10,066,901 B2 * 9/2018 Dahl ..... F41C 33/0236
D942,122 S * 2/2022 Azizova ..... D2/828
D942,123 S * 2/2022 Azizova ..... D2/828
11,832,659 B1 * 12/2023 Solotoff ..... A61F 7/02
2003/0182714 A1 * 10/2003 Mariland ..... A41D 13/0015 2/247
2004/0133967 A1 * 7/2004 West ..... A41D 27/10 2/247
2004/0250331 A1 * 12/2004 Bayer ..... A41D 15/005 2/69
2006/0230503 A1 * 10/2006 Shterenberg ..... A41F 9/00 2/309
2011/0078840 A1 * 4/2011 Thompson ..... A41D 27/20 2/400
2013/0239298 A1 * 9/2013 Jordan ..... A41D 27/20 2/250
2014/0026288 A1 * 1/2014 Passman ..... A41D 13/0012 2/102
2015/0082509 A1 * 3/2015 Davis ..... A41D 13/02 2/79
2015/0289570 A1 * 10/2015 Conrad ..... A41C 3/0035 450/89
2019/0098949 A1 * 4/2019 Messner ..... A41D 27/201

* cited by examiner

OUTER GARMENT WITH COVERTLY RELEASABLE FLAP

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE DISCLOSURE

1. Field of the Disclosure

The present disclosure relates generally to the field of covering outer garments and is particularly directed to an outer garment with a covert releasable flap.

2. Description of Related Art

It is known to have outer covering, "side-zip" jackets with two upside-down zippers at the 3 and 9 o'clock positions. These jackets are typically worn by law enforcement agents and allow the wearer to unzip one of the "side-zip" zippers so that a holstered firearm can extend through the unzipped portion of the jacket, allowing unrestricted access to the holstered firearm while the jacket is being worn.

It is also known to provide outer covering jackets with bottomless or pass-through pockets that allow a user to reach through the bottom of a pocket to access a firearm concealed under the jacket.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY AND OBJECTS OF THE DISCLOSURE

Unfortunately, there are a number of shortcomings to these known jackets. For example, side-zip jackets do not allow the wearer to access a firearm covertly. In order to have access to the firearm, the wearer must unzip the side zipper, which exposes the firearm and allows it to be viewed.

Side-zip jackets must either be previously unzipped (exposing the holstered firearm) or provide for a slow deployment, as the wearer must first unzip the zipper before accessing the holstered firearm. The wearer cannot covertly grip the firearm using a side-zip jacket.

Jackets with bottomless or pass-through pockets allow the wearer to access a firearm through the jacket pocket but require the firearm to be withdrawn through the jacket pocket before firing, the firearm to be fired through the jacket, or the user to fumble with the bottom portion of the jacket to move it out of the way before firing the firearm. If the bottom portion of the jacket is moved out of the way, the wearer's arm is still extending through the pass-through pocket and movement is hindered by the jacket.

These and other disadvantages of the prior art are overcome with the present disclosure, wherein the outer garment with a covertly releasable flap that does not require the wearer to place firearm in a pocket of the garment but allows a wearer to access a firearm being carried on the wearer's body.

In various exemplary, non-limiting embodiments, the outer garment with a covertly releasable flap of the present disclosure provides at least some of a garment body having a garment centerline extending along a longitudinal axis of the garment body, wherein an outer portion of the garment body extends from the centerline to a terminal side edge of the outer portion to form a gap in the outer portion between the terminal side edge of the outer portion and the centerline of the outer portion; a flap positioned so as to overlay the gap, wherein the flap extends such that a terminal bottom edge of the flap is coextensive with a terminal bottom edge of the outer portion, wherein the flap extends such that a terminal side edge of the flap extends beyond the terminal side edge of the outer portion to overlay at least a portion of the outer portion of the garment body, proximate the terminal side edge of the outer portion, wherein at least a portion of the flap proximate the terminal bottom edge of the flap and proximate the terminal side edge of the flap is releasably attached or coupled to at least a portion of the outer portion of the garment body, via one or more releasable fasteners, proximate the terminal bottom edge of the outer portion and proximate the terminal side edge of the outer portion; and a faux pocket opening formed between at least a portion of the flap and at least a portion of the outer portion of the garment body, wherein the one or more releasable fasteners are between the faux pocket opening and the terminal bottom edge of the outer portion.

In various exemplary, non-limiting embodiments, the garment is a long sleeve, short sleeve, or sleeveless jacket, vest, hoodie, pullover, sweater, sweatshirt, or shirt.

In various exemplary, non-limiting embodiments, the garment body includes a substantially uninterrupted portion of material across the centerline.

In various exemplary, non-limiting embodiments, the garment body includes a closable opening along the centerline.

In various exemplary, non-limiting embodiments, the garment body includes a pocket formed on one side of the centerline, wherein the pocket includes a visually and/or tactilely identifiable pocket seam around at least a portion of an outer edge of the pocket opening.

In various exemplary, non-limiting embodiments, the flap is formed of a separate portion of material at least partially attached or coupled to one or more portions of the outer portion of the garment body.

In various exemplary, non-limiting embodiments, the flap is an integral extension of at least a portion of the outer portion of the garment body.

In various exemplary, non-limiting embodiments, one or more releasable fasteners are positioned proximate overlapping portions of the outer portion of the garment body and the flap, proximate the terminal side edge of the outer portion of the flap and the terminal side edge of the flap.

In various exemplary, non-limiting embodiments, at least a portion of the faux pocket opening includes a faux pocket seam formed proximate the terminal side edge of the flap.

In various exemplary, non-limiting embodiments, at least a portion of the faux pocket opening includes a faux pocket seam formed proximate the terminal side edge of the flap and wherein the faux pocket seam creates a visual appearance of a pocket seam.

In various exemplary, non-limiting embodiments, the one or more releasable fasteners are between the faux pocket opening and the terminal bottom edge of the flap.

In various exemplary, non-limiting embodiments, one or more supplemental releasable fasteners are included.

In various exemplary, non-limiting embodiments, at least one element of a mating portion of one or more supplemental releasable fasteners attached or coupled to a corresponding portion of the flap proximate the terminal side edge of the flap, at least one corresponding element of a mating portion of the one or more supplemental releasable fasteners attached or coupled to a corresponding portion of the outer portion of the garment body proximate the terminal side edge of the outer portion, wherein the faux pocket opening is formed between the one or more releasable fasteners and the one or more supplemental releasable fasteners.

In various exemplary, non-limiting embodiments, the faux pocket opening provides access between the outer portion of the garment body and an inner portion of the garment body.

In various exemplary, non-limiting embodiments, the outer garment with a covertly releasable flap of the present disclosure provides at least some of a garment body having a garment centerline extending along a longitudinal axis of the garment body, wherein an outer portion of the garment body extends from the centerline to a terminal side edge of the outer portion to form a gap in the outer portion between the terminal side edge of the outer portion and the centerline of the outer portion; a flap positioned so as to overlay the gap, wherein the flap extends such that a terminal bottom edge of the flap is coextensive with a terminal bottom edge of the outer portion, wherein the flap extends such that a terminal side edge of the flap extends beyond the terminal side edge of the outer portion to overlay at least a portion of the outer portion of the garment body, proximate the terminal side edge of the outer portion; at least one element of a mating portion of one or more releasable fasteners attached or coupled to a corresponding portion of the flap proximate the terminal bottom edge of the flap and proximate the terminal side edge of the flap, at least one corresponding element of a mating portion of the one or more releasable fasteners attached or coupled to a corresponding portion of the outer portion of the garment body proximate the terminal bottom edge of the outer portion and proximate the terminal side edge of the outer portion; and a faux pocket opening formed between at least a portion of the flap and at least a portion of the outer portion of the garment body, wherein the one or more releasable fasteners are between the faux pocket opening and the terminal bottom edge of the outer portion.

In various exemplary, non-limiting embodiments, the outer garment with a covertly releasable flap of the present disclosure provides at least some of a garment body, wherein an outer portion of the garment body extends from a first terminal side edge of the outer portion to a second terminal side edge of the outer portion to form a gap in the outer portion between the first terminal side edge of the outer portion and the second terminal side edge of the outer portion; a flap positioned so as to overlay the gap, wherein the flap extends such that a terminal bottom edge of the flap is coextensive with a terminal bottom edge of the outer portion, wherein the flap extends such that a first terminal side edge of the flap extends beyond the first terminal side edge of the outer portion to overlay at least a portion of the outer portion of the garment body and wherein the flap extends such that a second terminal side edge of the flap extends beyond the second terminal side edge of the outer portion to overlay at least a portion of the outer portion of the garment body, wherein at least a portion of the flap, proximate the first terminal side edge of the flap and the terminal bottom edge of the flap is releasably attached or coupled, via mating interaction of one or more releasable fasteners, to the outer portion of the garment body, proximate the terminal bottom edge of the outer portion and the first terminal side edge of the outer portion, and wherein at least a portion of the flap, proximate the second terminal side edge of the flap and the terminal bottom edge of the flap is releasably attached or coupled, via mating interaction of one or more releasable fasteners, to the outer portion of the garment body, proximate the terminal bottom edge of the outer portion and the second terminal side edge of the outer portion; a first faux pocket opening formed between at least a portion of the flap, proximate the first terminal side edge of the flap and at least a portion of the outer portion of the garment body, wherein at least some of the one or more releasable fasteners are between the first faux pocket opening and the first terminal bottom edge of the outer portion; and a second faux pocket opening formed between at least a portion of the flap, proximate the second terminal side edge of the flap and at least a portion of the outer portion of the garment body, wherein at least some of the one or more releasable fasteners are between the second faux pocket opening and the second terminal bottom edge of the outer portion.

Accordingly, the present disclosure separately and optionally provides an improved outer garment with a covertly releasable flap.

The present disclosure separately and optionally provides an improved outer garment that allows a user to covertly access a covered firearm.

The present disclosure separately and optionally provides an improved outer garment that is suitable for appendix carry.

The present disclosure separately and optionally provides an improved outer garment that provides a faux pocket opening so that a wearer can covertly access a firearm.

The present disclosure separately and optionally provides an outer garment with a covertly releasable flap that can be easily manipulated by a user.

These and other aspects, features, and advantages of the presently disclosed systems, methods, and/or apparatuses are described in or are apparent from the following detailed description of the exemplary, non-limiting embodiments of the presently disclosed systems, methods, and/or apparatuses and the accompanying figures. Other aspects and features of embodiments of the presently disclosed systems, methods, and/or apparatuses will become apparent to those of ordinary skill in the art upon reviewing the following description of specific, exemplary embodiments of the presently disclosed systems, methods, and/or apparatuses in concert with the figures. While features of the presently disclosed systems, methods, and/or apparatuses may be discussed relative to certain embodiments and figures, all embodiments of the presently disclosed systems, methods, and/or apparatuses can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the presently disclosed systems, methods, and/or apparatuses.

Any benefits, advantages, or solutions to problems that are described herein with regard to specific embodiments are not intended to be construed as a critical, required, or essential feature(s) or element(s) of the presently disclosed systems, methods, and/or apparatuses or the claims.

BRIEF DESCRIPTION OF THE DRAWINGS

As required, detailed exemplary embodiments of the present disclosure are disclosed herein; however, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF THE DISCLOSURE

Figure 1:
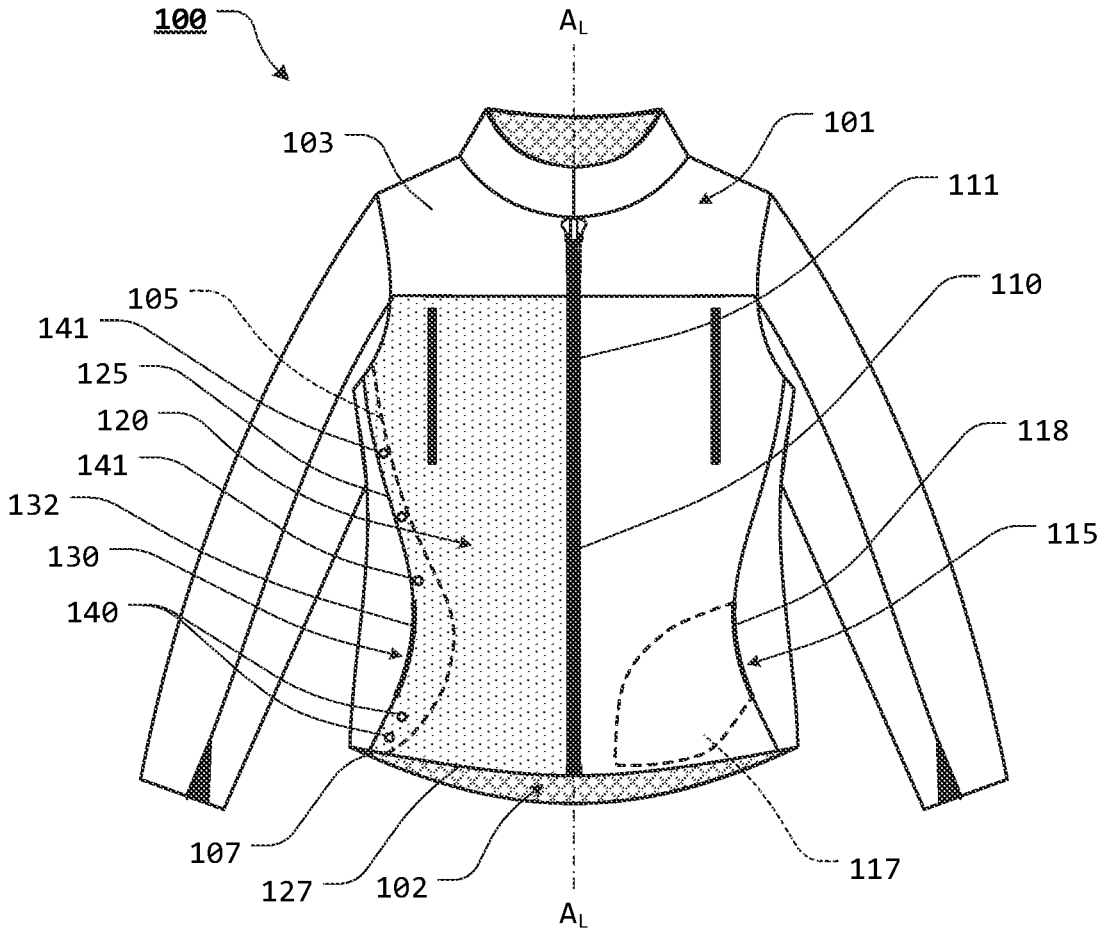
FIG. 1 illustrates a front view of certain exemplary components of an exemplary embodiment of an outer garment with a covertly releasable flap, wherein the covertly releasable flap is in a closed position, according to the present disclosure.

The foregoing and other objectives, features, and advantages of the invention will be more readily understood upon consideration of the following description of the invention taken in conjunction with the accompanying drawings.

For simplicity and clarification, the design factors and operating principles of the outer garment with a covertly releasable flap according to the present disclosure are explained with reference to various exemplary embodiments of outer garment with a covertly releasable flap according to the present disclosure. The basic explanation of the design factors and operating principles of the outer garment with a covertly releasable flap is applicable for the understanding, design, and operation of the outer garment with a covertly releasable flap of the present disclosure. It should be appreciated that the outer garment with a covertly releasable flap can be adapted to many applications where a switch or an outer garment with a covertly releasable flap is necessary or desirable.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

As used herein, the word "may" is meant to convey a permissive sense (i.e., meaning "having the potential to"), rather than a mandatory sense (i.e., meaning "must"). Unless stated otherwise, terms such as "first" and "second", "right" and "left", "top" and "bottom", "upper" and "lower", and "horizontal" and "vertical" are used to arbitrarily distinguish between the exemplary embodiments and/or elements such terms describe. Thus, these terms are not necessarily intended to indicate temporal or other prioritization of such exemplary embodiments and/or elements.

As used herein, and unless the context dictates otherwise, the term "coupled" is intended to include both direct coupling (in which two elements that are coupled to each other contact each other) and indirect coupling (in which at least one additional element is located between the two elements). The term coupled, as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that, for simplicity and clarification, certain embodiments of the present disclosure may be described using terms such as "front", "back", "rear", "right", "left", "upper", "lower", "outer", and/or "inner". However, it should be understood that these terms are merely used to aid in understanding of the present disclosure are not to be construed as limiting the systems, methods, devices, and/or apparatuses of the present disclosure. Additionally, it should be appreciated that, unless otherwise stated, the design factors and operating principles of the presently disclosed multidirectional explosive disruptor system may optionally be used in a "mirror image" assembly, wherein elements shown and/or described as being included in or on an upper or identified side portion may optionally be included in or on a lower or other side portion. Alternatively, certain of the elements that are shown and/or described as being included in or on a back portion may optionally be included in or on a front portion, or vice versa.

It should also be appreciated that the terms "outer garment", "covertly", and "releasable flap" are used for basic explanation and understanding of the operation of the systems, methods, and apparatuses of the present disclosure. Therefore, the terms "outer garment", "covertly", and "releasable flap" are not to be construed as limiting the systems, methods, and apparatuses of the present disclosure.

Furthermore, it should be appreciated that, for simplicity and clarification, the embodiments of the present disclosure will be shown and/or described with reference to the outer garment being utilized for the concealment of a firearm. However, it should be appreciated that this usage is merely exemplary and is not to be construed as limiting the present disclosure. Thus, the outer garment of the present disclosure may be utilized in connection with the concealment of any items and/or mere usage that allows quick or rapid access to items worn under the outer garment, such as, for example, a cell phone, keys, a fanny pack, first aid items, etc.

Additionally, it should be appreciated that, for simplicity and clarification, the embodiments of the present disclosure will be shown and/or described with reference to the the releasable flap being utilized in connection with an exemplary, long sleeve jacket. However, it should be appreciated that the this is merely an exemplary application of the present disclosure and the releasable flap may be utilized in connection with any garment. Thus, the releasable flap features and/or elements of the present disclosure may be utilized in connection with a variety of garments or garment types, including, but not limited to, a long sleeve, short sleeve, or sleeveless jacket, vest, hoodie, pullover, sweater, sweatshirt, shirt, or the like.

Figure 4:
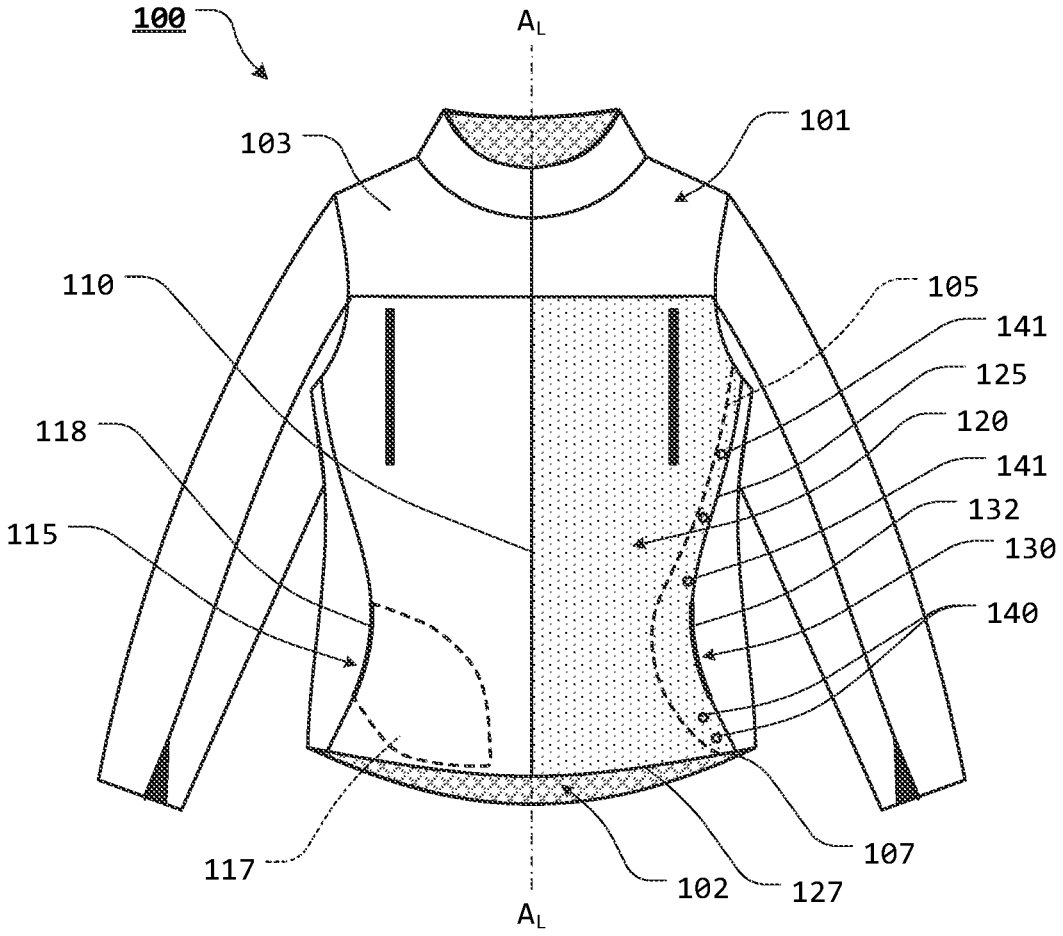
FIG. 4 illustrates a front view of certain exemplary components of an exemplary embodiment of an outer garment with a covertly releasable flap, wherein the covertly releasable flap is in a closed position, according to the present disclosure.
Figure 5:
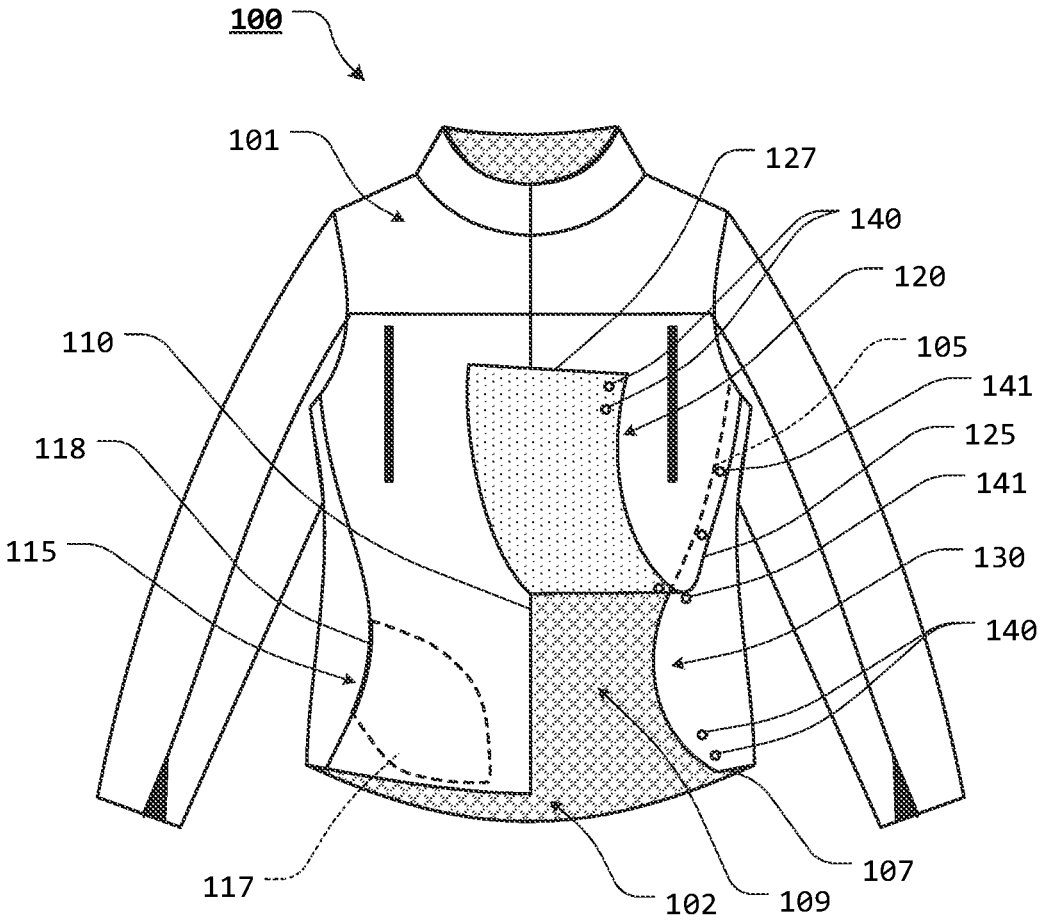
FIG. 5 illustrates a front view of certain exemplary components of an exemplary embodiment of an outer garment with a covertly releasable flap, wherein the covertly releasable flap is in an open position, according to the present disclosure.
Figure 6:
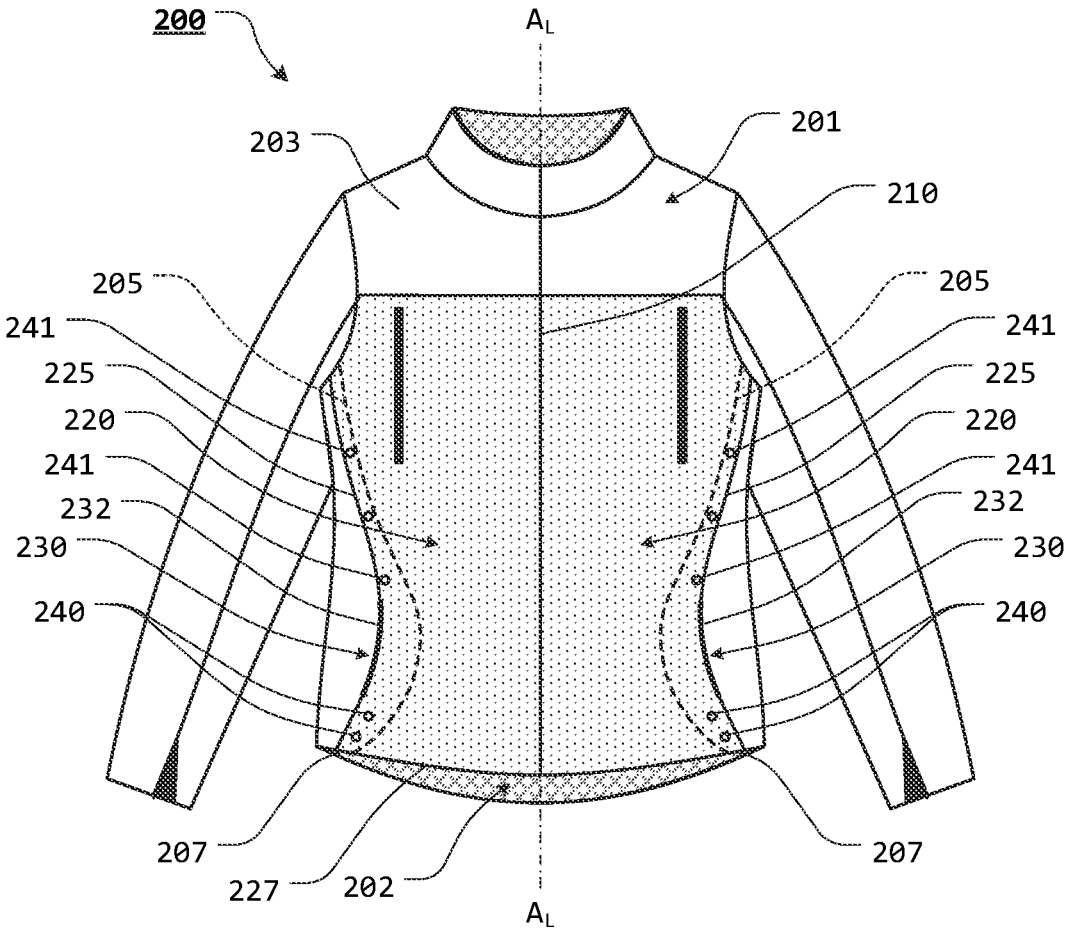
FIG. 6 illustrates a front view of certain exemplary components of an exemplary embodiment of an outer garment with a covertly releasable flap, wherein the covertly releasable flap is in a closed position, according to the present disclosure.
Figure 7:
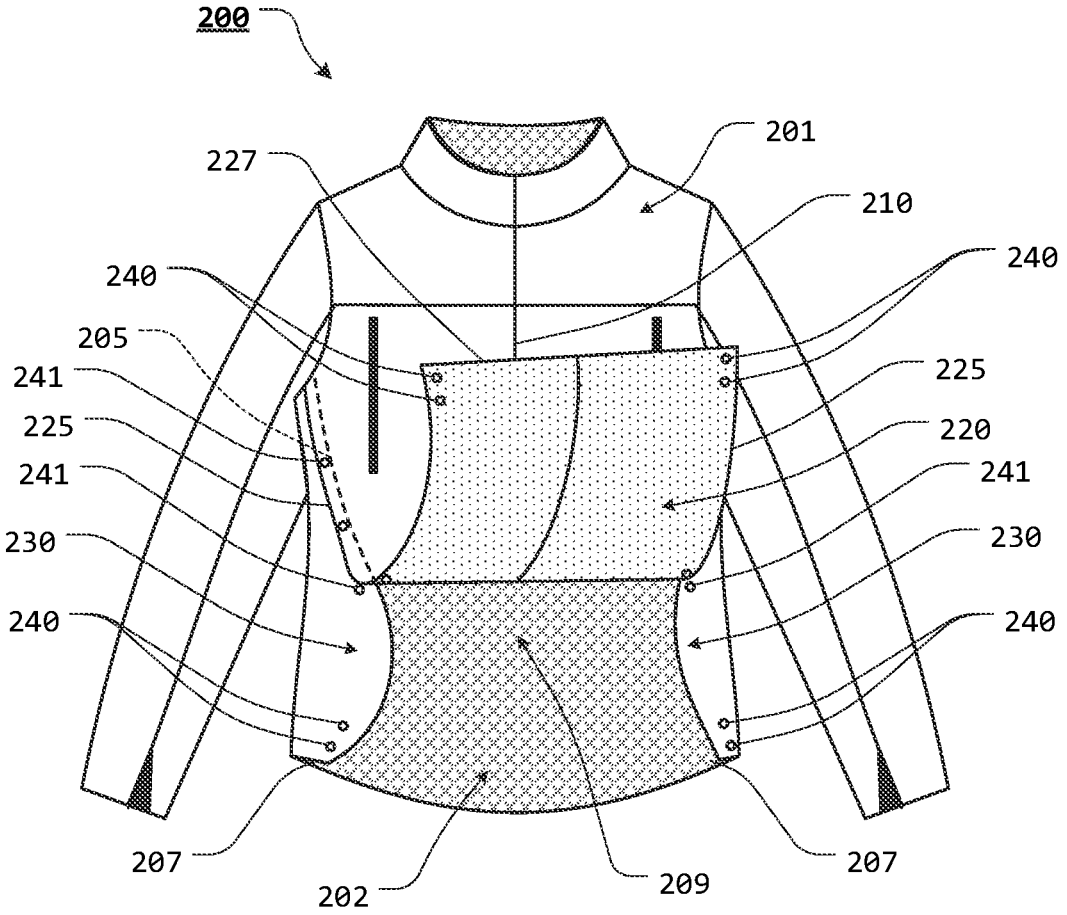
FIG. 7 illustrates a front view of certain exemplary components of an exemplary embodiment of an outer garment with a covertly releasable flap, wherein the covertly releasable flap is in an open position, according to the present disclosure.

In the form of the present disclosure chosen for purposes of illustration, FIGS. 1-5 illustrate various views of certain exemplary components and/or configurations of the garment 100 of the present disclosure, while FIGS. 6-7 illustrate various views of certain exemplary components and/or configurations of the garment 200 of the present disclosure.

In illustrative, non-limiting embodiment(s) of the present disclosure, as illustrated, for example, in FIGS. 1-3 and FIGS. 4-5, the garment 100 includes a garment body 103, having an outer portion 101 and an inner portion 102. It should be appreciated that the garment 100 is generally illustrated as a jacket. However, the garment 100 is not so limited and may comprise any appropriate garment or garment type, including, but not limited to, a long sleeve, short sleeve, or sleeveless jacket, vest, hoodie, pullover, sweater, sweatshirt, shirt, or the like.

Figure 2:
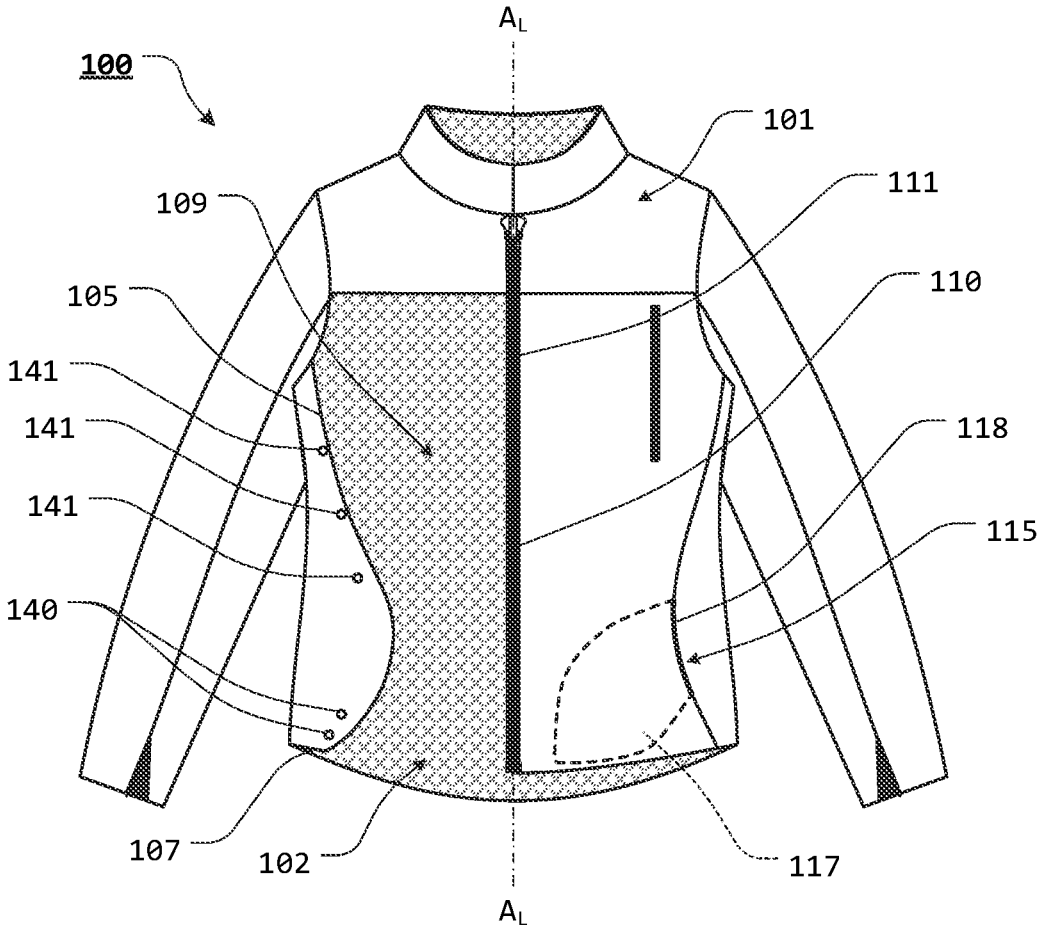
FIG. 2 illustrates a front view of certain exemplary components of an exemplary embodiment of an outer garment with a covertly releasable flap, wherein the covertly releasable flap is in an open position, according to the present disclosure.
Figure 3:
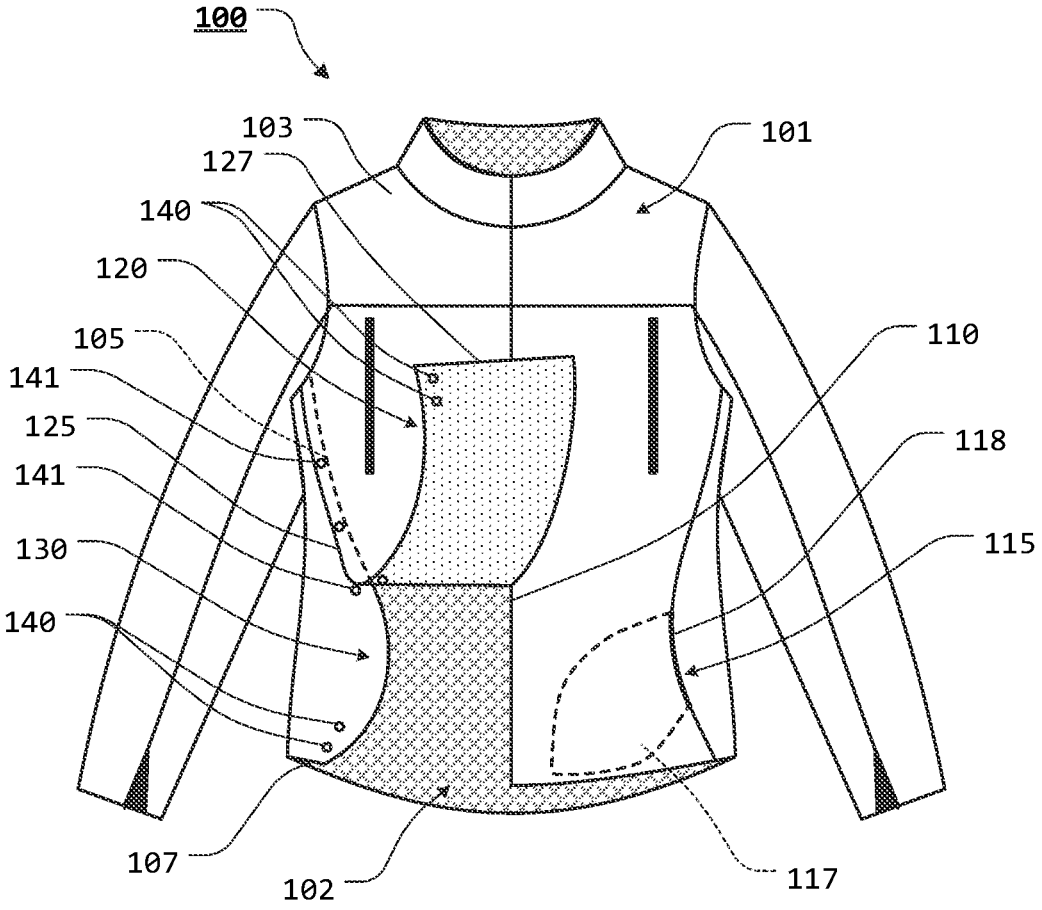
FIG. 3 illustrates a front view of certain exemplary components of an exemplary embodiment of an outer garment with a covertly releasable flap, wherein the covertly releasable flap is in an open position, according to the present disclosure.

It should be appreciated that the garment 100 illustrated in FIGS. 1-3 is substantially similar to the garment 100 illustrated in FIGS. 4-5. However, the garment 100 illustrated in FIGS. 4-5 is a mirror image of the garment 100 illustrated in FIGS. 1-3, showing that the features and/or elements of the garment 100 may be included on either a right side or a left side of the garment 100.

The garment body 103 generally has a garment centerline 110 extending generally between the top and bottom of the garment body 103, along a longitudinal axis, $A_L$, of the garment body 103.

Depending on the type or style of garment 100, the garment body 103 may be formed of a substantially uninterrupted portion of material across the centerline 110. Alternatively, the garment body 103 may include an opening along the centerline 110 and may be capable of being separated along the centerline 110 and closed along the centerline 110 via a closure 111, such as, for example, mating portions of a zipper, buttons, snaps, hook and loop portions, etc.

In certain exemplary, nonlimiting embodiments, the garment body 103 may optionally include a pocket 117 formed on one side or the other of the centerline 110. If included, the pocket 115 may be accessed by a pocket opening 117. A pocket seam 118 may be included around an outer edge of the pocket opening 115. The pocket seam 118 generally provides a degree of reinforcement to the pocket opening 115 and allows the pocket opening 115 to be visually and/or tactilely identified.

As illustrated in FIGS. 1-3, the pocket 117 may optionally be included on a wearer's left side of the garment body 103 while, as illustrated in FIGS. 4 and 5, the pocket 117 may optionally be included on a wearer's right side of the garment body 103.

As illustrated most clearly in FIG. 2, the outer portion 101 of the front of the garment body 103 extends from the centerline 110, around the back of the garment body 103, to a terminal side edge 105 of the outer portion 101. Thus, a gap 109 is created in the front of the outer portion 101 between the terminal side edge 105 and the centerline 110 of the outer portion 101.

A flap 120 is positioned so as to overlay and cover the gap 109 in the front of the outer portion 101 between the terminal side edge 105 and the centerline 110 of the outer portion 101. In various exemplary embodiments, the flap 120 is formed of a separate portion of material attached or coupled to one or more portions of the outer portion 101 of the garment body 103. Alternatively, the flap 120 may optionally be an integral extension of at least a portion of the outer portion 101 of the garment body 103.

Thus, the flap 120 may be an integral extension of the outer portion 101 or a separate portion of material attached or coupled to the outer portion 101.

In various exemplary embodiments, the flap 120 extends such that a terminal bottom edge 127 of the flap 120 extends to be coextensive with a terminal bottom edge 107 of the outer portion 101. The flap 120 also extends such that a terminal side edge 125 of the flap 120 extends beyond the terminal side edge 105 of the outer portion 101 to overlay at least a portion of the outer portion 101, proximate the terminal side edge 105 of the outer portion 101.

At least one element of a mating portion of one or more releasable fasteners 140 are attached or coupled to corresponding portions of the flap 120 and the outer portion 101 of the garment body 103, proximate the terminal bottom edge 107 and the terminal side edge 105 of the outer portion 101 and the terminal bottom edge 127 and the terminal side edge 125 of the flap 120. In this manner, a portion of the flap 120, proximate the intersection of the terminal side edge 125 and the terminal bottom edge 127 of the flap 120 may be releasably attached or coupled, via mating interaction of the one or more releasable fasteners 140, with the outer portion 101 of the garment body 103, proximate the intersection of the terminal bottom edge 107 and the terminal side edge 105 of the outer portion 101.

In various exemplary embodiments, each of the one or more releasable fasteners 140 includes a mating portion of, for example, one or more male/female snap-release buckles, one or more buttons, snaps, magnets, a hook and loop fastener, such as Velcro, or any known or later developed releasable fastening, closure, or attachment means.

Thus, a corresponding, overlapping portion of the flap 120 may be repeatably releasably attached or coupled, via interaction of the one or more releasable fasteners 140 to the outer portion 101.

In certain exemplary embodiments, one or more supplemental releasable fasteners 141 (similar or identical to the releasable fasters 140), are positioned proximate overlapping portions of the outer portion 101 and the flap 120, proximate the terminal side edge 105 of the outer portion 101 and the terminal side edge 125 of the flap 120. If included, the one or more mating, releasable fasters 141 act to further releasably secured one or more portions of the flap 120 to the outer portion 101.

A faux pocket opening 130 is created between at least a portion of the flap 120 and the outer portion 101. In various exemplary embodiments, at least a portion of the faux pocket opening 130 includes a faux pocket seam 132 formed proximate the terminal edge side 125 of the flap 120. If included, the faux pocket seam 132 creates the visual appearance of the pocket seam of a pocket opening, such as, for example, the pocket seam 118 of the pocket opening 115. The inclusion of the faux pocket seam 132 acts to create a visual impression that the faux pocket opening 130 is a real pocket opening, thus further concealing the faux pocket opening 130.

The faux pocket opening 130 is formed proximate the one or more releasable fasteners 140, such that the releasable fasteners 140 are formed between the faux pocket opening 130 and the terminal bottom edge 107 of the outer portion 101 and the terminal bottom edge 127 of the flap 120.

If one or more supplemental releasable fasteners 141 are included, the faux pocket opening 130 is formed between the one or more releasable fasteners 140 and the one or more supplemental releasable fasteners 141.

As illustrated most clearly in FIGS. 3 and 5, during use of the garment 100, a user is able to insert their hand between a portion of the flap 120 and the outer portion 101, within an area of the faux pocket opening 130. Visually, this act would look similar to the user inserting a hand into a normal, traditional pocket. When the user's hand is inserted between a portion of the flap 120 and the outer portion 101, the user is able to access the inner portion 102 of the garment 100 to access or grasp, for example, a concealed firearm.

If the user chooses to draw the concealed firearm, the user need only to move the hand forward or outward, away from the user's body and the garment 100 (i.e., by executing a normal draw stroke). As the user moves the hand forward or outward, a separating force is applied to at least the releasable fasteners 140, separating the releasable fasteners 140 and allowing the flap 120 to be at least partially released from the outer portion 101 of the garment body 103. In this manner, at least a portion of the flap 120 is released from the outer portion 101 and the user's hand is eventually able to clear the flap 120 to be unimpeded by any portion of the garment 100.

If supplemental releasable fasteners 141 are also included, the degree of forwarder outward movement of the user's hand may also apply a separating force to the supplemental releasable fasteners 141, separating one or more of the supplemental releasable fasteners 141 and allowing the flap 120 to be further released from the outer portion 101 of the garment body 103.

It should be understood that the garment 100, as illustrated in FIGS. 1-3 generally allows a user to access the faux pocket opening 130 with a right hand, while the garment 100, as illustrated in FIGS. 4-5 generally allows a user to access the faux pocket opening 130 with a left hand.

In illustrative, non-limiting embodiment(s) of the present disclosure, as illustrated, for example, in FIGS. 6-7, the garment 200 includes a garment body 203 having an outer portion 201 and an inner portion 202, terminal side edges 205, a terminal bottom edge 207, a gap 209, a centerline 210, an optional closure 211, a flap 220 having terminal side edges 225 and a terminal bottom edge 227, faux pocket openings 230, optional faux pocket seams 232, one or more releasable fasteners 240, and one or more optional releasable fasteners 241.

It should be appreciated that each of these elements corresponds to and operates similarly to the garment body 103, the outer portion 101, the inner portion 102, the terminal side edge 105, the terminal bottom edge 107, the gap 209, the centerline 110, the optional closure 111, the flap 120, the terminal side edge 125, the terminal bottom edge 127, the faux pocket opening 130, the optional faux pocket seam 132, the one or more releasable fasteners 140, and the one or more optional supplemental releasable fasteners 141, as described herein, with reference to the garment 100.

However, as illustrated in FIGS. 6-7, the outer portion 201 of the front of the garment body 203 extends between two terminal side edges 205 of the outer portion 201. Thus, the gap 209 is created in the front of the outer portion 201 between the two terminal side edges 205 of the outer portion 201 and includes at least a portion of any optional closure 211 of the outer portion 201.

Releasable fasteners 240 and optional releasable fasteners 241 are positioned along each of the terminal side edges 205 of the outer portion 201 and each of the terminal side edges 225 of the flap 220.

Thus, the garment 200 provides a faux pocket opening 230 that can be accessed by a user's right hand and a separate faux pocket opening 230 that can be accessed by a user's left hand.

Additionally, the flap 220 extends between two terminal side edges 205 of the outer portion 201 and not merely between the centerline 210 and a terminal side edge 205 of the outer portion 201.

It should also be appreciated that a more detailed explanation of the specific dimensions of certain components of the garment 100 and/or the garment 200, instructions regarding how to install the garment 100 and/or the garment 200, additional methods for using the garment 100 and/or the garment 200, and certain other items and/or techniques necessary for the implementation and/or operation of the various exemplary embodiments of the present disclosure are not provided herein because such background information will be known to one of ordinary skill in the art. Therefore, it is believed that the level of description provided herein is sufficient to enable one of ordinary skill in the art to understand and practice the systems, methods, and apparatuses of the presentation, as described.

It should be appreciated that the outer garment with a covertly releasable flap of the present disclosure is not limited to the embodiment illustrated and described as the garment 100 and/or the garment 200.

While the present disclosure has been described in conjunction with the exemplary embodiments outlined above, the foregoing description of exemplary embodiments of the present disclosure, as set forth above, are intended to be illustrative, not limiting and the fundamental disclosure should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein. Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A garment with a releasable flap, comprising:

a garment body having an outer portion and an inner portion, wherein said garment body includes a garment centerline extending along a longitudinal axis of said garment body, wherein said garment body extends from said centerline to a terminal side edge of said garment body to form a gap in said garment body between said terminal side edge of said garment body and said centerline of said garment body, wherein said gap provides access to said inner portion of said garment body;

a flap positioned so as to overlay said gap, wherein said flap extends such that a terminal bottom edge of said flap is coextensive with a terminal bottom edge of said garment body, wherein said flap extends such that a terminal side edge of said flap extends beyond said terminal side edge of said garment body to overlay at least a portion of said outer portion of said garment body, proximate said terminal side edge of said garment body, wherein at least a portion of said flap proximate said terminal bottom edge of said flap and proximate said terminal side edge of said flap is releasably attached or coupled to at least a portion of said outer portion of said garment body, via one or more releasable fasteners, proximate said terminal bottom edge of said outer portion and proximate said terminal side edge of said outer portion; and a faux pocket opening defined by a portion of said flap that overlays at least a portion of said outer portion of said garment body between at least a portion of said flap and at least a portion of said outer portion of said garment body, wherein said faux pocket opening provides access to said inner portion of said garment body, wherein said one or more releasable fasteners are between said faux pocket opening and said terminal bottom edge of said outer portion, and wherein said faux pocket opening operates with said flap such that if a portion of the faux pocket opening moves away from said outer portion of said garment body at least a portion of said flap moves away from said outer portion of said garment body.

2. The garment with a releasable flap of claim 1, wherein said garment is a long sleeve, short sleeve, or sleeveless jacket, vest, hoodie, pullover, sweater, sweatshirt, or shirt.

3. The garment with a releasable flap of claim 1, wherein said gap is formed such that said outer portion of said garment body and said inner portion of said garment body extend between said terminal side edge of said garment body and said centerline of said garment body.

4. The garment with a releasable flap of claim 1, wherein said garment body includes a closable opening along said centerline.

5. The garment with a releasable flap of claim 1, wherein said garment body includes a pocket formed on one side of said centerline, wherein said pocket includes a visually and/or tactilely identifiable pocket seam around at least a portion of an outer edge of said pocket opening.

6. The garment with a releasable flap of claim 1, wherein said flap is formed of a separate portion of material at least partially attached or coupled to one or more portions of said outer portion of said garment body.

7. The garment with a releasable flap of claim 1, wherein said flap is an integral extension of at least a portion of said outer portion of said garment body.

8. The garment with a releasable flap of claim 1, wherein one or more releasable fasteners are positioned proximate overlapping portions of said outer portion of said garment body and said flap, proximate said terminal side edge of said outer portion of said flap and said terminal side edge of said flap.

9. The garment with a releasable flap of claim 1, wherein at least a portion of said faux pocket opening includes a faux pocket seam formed proximate said terminal side edge of said flap.

10. The garment with a releasable flap of claim 1, wherein at least a portion of said faux pocket opening includes a faux pocket seam formed proximate said terminal side edge of said flap and wherein said faux pocket seam creates a visual appearance of a pocket seam.

11. The garment with a releasable flap of claim 1, wherein said one or more releasable fasteners are between said faux pocket opening and said terminal bottom edge of said flap.

12. The garment with a releasable flap of claim 1, wherein said inner portion of said garment body and said outer portion of said garment body each extend from said centerline, around a back of said garment body, to said terminal side edge of said garment body.

13. The garment with a releasable flap of claim 1, wherein at least one element of a mating portion of one or more supplemental releasable fasteners attached or coupled to a corresponding portion of said flap proximate said terminal side edge of said flap, at least one corresponding element of a mating portion of said one or more supplemental releasable fasteners attached or coupled to a corresponding portion of said outer portion of said garment body proximate said terminal side edge of said outer portion, wherein said faux pocket opening is formed between said one or more releasable fasteners and said one or more supplemental releasable fasteners.

14. The garment with a releasable flap of claim 1, wherein said faux pocket opening provides access between said outer portion of said garment body and an inner portion of said garment body.

15. A garment with a releasable flap, comprising:

a garment body having an outer portion and an inner portion, wherein said garment body includes a garment centerline extending along a longitudinal axis of said garment body, wherein said garment body extends from said centerline to a terminal side edge of said garment body to form a gap in said garment body between said terminal side edge of said garment body and said garment centerline, wherein said gap provides access to said inner portion of said garment body;

a flap positioned so as to overlay said gap, wherein said flap extends such that a terminal bottom edge of said flap is coextensive with a terminal bottom edge of said outer portion, wherein said flap extends such that a terminal side edge of said flap extends beyond said terminal side edge of said outer portion to overlay at least a portion of said outer portion of said garment body, proximate said terminal side edge of said outer portion;

at least one element of a mating portion of one or more releasable fasteners attached or coupled to a corresponding portion of said flap proximate said terminal bottom edge of said flap and proximate said terminal side edge of said flap, at least one corresponding element of a mating portion of said one or more releasable fasteners attached or coupled to a corresponding portion of said outer portion of said garment body proximate said terminal bottom edge of said outer portion and proximate said terminal side edge of said outer portion; and a faux pocket opening defined by a portion of said flap that overlays at least a portion of said outer portion of said garment body between at least a portion of said flap and at least a portion of said outer portion of said garment body, wherein said faux pocket opening provides access to said inner portion of said garment body, wherein said one or more releasable fasteners are between said faux pocket opening and said terminal bottom edge of said outer portion, and wherein said faux pocket opening operates with said flap such that movement of a portion of the faux pocket opening away from said outer portion of said garment body results in movement of at least a portion of said flap away from said outer portion of said garment body.

16. The garment with a releasable flap of claim 15, wherein said flap is formed of a separate portion of material at least partially attached or coupled to one or more portions of said outer portion of said garment body.

17. The garment with a releasable flap of claim 15, wherein said flap is an integral extension of at least a portion of said outer portion of said garment body.

18. A garment with a releasable flap, comprising:

a garment body having an outer portion and an inner portion, wherein at least a portion of said outer portion of said garment body extends from a first terminal side edge of said garment body to a second terminal side edge of said garment body to form a gap in said garment body between said first terminal side edge of said garment body and said second terminal side edge of said garment body, wherein said gap provides access to said inner portion of said garment body;

a flap positioned so as to overlay said gap, wherein said flap extends such that a terminal bottom edge of said flap is coextensive with a terminal bottom edge of said outer portion, wherein said flap extends such that a first terminal side edge of said flap extends beyond said first terminal side edge of said outer portion to overlay at least a portion of said outer portion of said garment body and wherein said flap extends such that a second terminal side edge of said flap extends beyond said second terminal side edge of said outer portion to overlay at least a portion of said outer portion of said garment body, wherein at least a portion of said flap, proximate said first terminal side edge of said flap and said terminal bottom edge of said flap is releasably attached or coupled, via mating interaction of one or more releasable fasteners, to said outer portion of said garment body, proximate said terminal bottom edge of said outer portion and said first terminal side edge of said outer portion, and wherein at least a portion of said flap, proximate said second terminal side edge of said flap and said terminal bottom edge of said flap is releasably attached or coupled, via mating interaction of one or more releasable fasteners, to said outer portion of said garment body, proximate said terminal bottom edge of said outer portion and said second terminal side edge of said outer portion;

a first faux pocket opening defined by a portion of said flap that overlays at least a portion of said outer portion of said garment body between at least a portion of said flap, proximate said first terminal side edge of said flap and at least a portion of said outer portion of said garment body, wherein said first faux pocket opening provides access to said inner portion of said garment body, wherein at least some of said one or more releasable fasteners are between said first faux pocket opening and said first terminal bottom edge of said outer portion, and wherein said first faux pocket opening operates with said flap such that if a portion of the first faux pocket opening moves away from said outer portion of said garment body at least a portion of said flap moves away from said outer portion of said garment body; and a second faux pocket opening defined by a portion of said flap that overlays at least a portion of said outer portion of said garment body between at least a portion of said flap, proximate said second terminal side edge of said flap and at least a portion of said outer portion of said garment body, wherein said second faux pocket opening provides access to said inner portion of said garment body, wherein at least some of said one or more releasable fasteners are between said second faux pocket opening and said second terminal bottom edge of said outer portion, and wherein said second faux pocket opening operates with said flap such that if a portion of the second faux pocket opening moves away from said outer portion of said garment body at least a portion of said flap moves away from said outer portion of said garment body.

19. The garment with a releasable flap of claim 18, wherein said flap is formed of a separate portion of material at least partially attached or coupled to one or more portions of said outer portion of said garment body.

20. The garment with a releasable flap of claim 18, wherein said flap is an integral extension of at least a portion of said outer portion of said garment body.

* * * * *